US009051109B2

(12) United States Patent
Rossiter et al.

(10) Patent No.: US 9,051,109 B2
(45) **Date of Patent: *Jun. 9, 2015**

(54) TESTING APPARATUS FOR TESTING A GAS AND/OR COMBUSTION PRODUCT DETECTOR

(75) Inventors: William Rossiter, Churchill (GB); Edwin Ozaki Owen, Welwyn Garden City (GB)

(73) Assignee: NO CLIMB PRODUCTS LIMITED, Welham Green, Hertfordshire (GB)

( * ) Notice: Subject to any disclaimer, the term of this patent is extended or adjusted under 35 U.S.C. 154(b) by 510 days.

This patent is subject to a terminal disclaimer.

(21) Appl. No.: 12/343,641

(22) Filed: Dec. 24, 2008

(65) Prior Publication Data

US 2009/0224081 A1 Sep. 10, 2009

(30) Foreign Application Priority Data

Mar. 4, 2008 (GB) ..... 0804042.0

(51) Int. Cl.

| | |
|---|---|
| ***B05B 1/28*** | (2006.01) |
| ***B65D 83/38*** | (2006.01) |
| ***B65D 83/30*** | (2006.01) |
| *G08B 29/14* | (2006.01) |

(52) U.S. Cl.

CPC ..... *B65D 83/384* (2013.01); *B65D 83/30* (2013.01); *G08B 29/145* (2013.01)

(58) Field of Classification Search

CPC .... B65D 83/384; B65D 83/30; B65D 83/303; G08B 29/145

USPC ..... 239/120–122, 288–288.5, 290, 340, 239/343, 456, 504, 505, 514, 523, 104, 589

See application file for complete search history.

(56) References Cited

U.S. PATENT DOCUMENTS

| | | | | | |
|---|---|---|---|---|---|
| 3,191,867 | A | * | 6/1965 | Helms | 239/288.5 |
| 3,209,751 | A | * | 10/1965 | Wakeman | 128/200.23 |
| 3,618,822 | A | | 11/1971 | Hildenbrandt, Jr. | 222/3 |
| 3,693,401 | A | | 9/1972 | Purt et al. | 73/1 R |
| 3,927,806 | A | * | 12/1975 | Meshberg | 222/402.12 |
| 3,935,999 | A | * | 2/1976 | Weyn | 239/288.5 |
| 3,994,421 | A | * | 11/1976 | Hansen | 222/182 |
| 4,271,693 | A | | 6/1981 | Bute | 73/1 G |
| 4,301,674 | A | | 11/1981 | Haines et al. | 73/1 G |
| 4,462,244 | A | | 7/1984 | Lee | 73/1 G |
| 4,637,528 | A | * | 1/1987 | Wachinski et al. | 222/182 |
| 5,060,503 | A | | 10/1991 | Spohn | 73/1 G |
| 5,344,076 | A | * | 9/1994 | Mercurio | 239/120 |

(Continued)

FOREIGN PATENT DOCUMENTS

| | | | |
|---|---|---|---|
| EP | 0 255 575 | 5/1987 | A45D 34/00 |
| GB | 2 181 489 | 4/1987 | B65D 83/14 |

*Primary Examiner* — Jason Boeckmann

(74) *Attorney, Agent, or Firm* — Renner Kenner Greive Bobak Taylor & Weber

(57) ABSTRACT

Apparatus is provided which comprises a container arranged to contain a material dispensable as a spray, aerosol or particulate through an outlet aperture, and a spacer member, wherein the spacer member is movable between a first position which is convenient for carrying and/or storage and a second position which determines a minimum distance between the outlet aperture and the target surface area or object for the spray, aerosol or particulate. Preferably, the spacer member when in the first position can inhibit the spray, aerosol or particulate from directly impacting the target surface, area or object.

21 Claims, 7 Drawing Sheets

(56) References Cited

U.S. PATENT DOCUMENTS 5,361,623 A 11/1994 Wantz ..... 73/1 G
5,809,996 A * 9/1998 Alldredge ..... 128/200.23
6,293,279 B1 * 9/2001 Schmidt et al. ..... 128/200.23
6,712,070 B2 * 3/2004 Drachmann et al. ..... 128/203.12
D611,122 S * 3/2010 Rossiter et al. ..... D23/213
2003/0029447 A1 2/2003 Vito

* cited by examiner

TESTING APPARATUS FOR TESTING A GAS AND/OR COMBUSTION PRODUCT DETECTOR

The present invention relates to the correct use of an aerosol spray or particulate dispenser, the enhancing of its performance and the prevention of its use too close to a surface, area or object whereby inappropriate residues or surface coatings would otherwise result.

Aerosol containers or canisters are used to deliver or dispense a mixture of ingredients in particulate form usually under pressure. Usually the mixture of ingredients is contained within a container that is pressurised either manually or, commonly, through the use of chemicals known as propellants before being released, usually by means of a manually operated valve and usually finally exiting through a nozzle or actuator. The particulate, spray or aerosol, its profile and characteristics that result are derived from the particular combination and interaction of these chemical ingredients and components and can be defined and controlled closely through appropriate definition and selection of components.

What is often less closely controlled is the distance between the aerosol dispenser outlet and the physical area, object or surface at which it may be directed. In some cases (such as air freshener for example) the spray is not intended to be directed at a physical surface and this may not be a significant concern. In other cases it is more important (underarm deodorant used too close to the skin or clothing can result in unsightly stains or deposits if dispensed too close for example). In many cases it is vital to the correct operation of the product and prevention of damage. One of the better known examples of this is the use of spray paint too close to the surface to be painted whereby droplets, unwanted patterns and sometimes rivulet run off occurs rather than the even coating promised by the product particulars. Furniture polish is another example and staining may occur through incorrect use. In some cases incorrect use may even be indirectly life threatening. Aerosol smoke or hazard detector testers that are used too close can result in inappropriate residues and deposits on and in detectors that, aside from being unsightly, can adversely affect the performance of the smoke or hazard detector. For these reasons products usually carry instructions that a certain distance should be maintained between the exit of the aerosol and the object or area at which it is directed. These directions are, however, often not followed.

While, in certain cases, dispensing apparatus exists to control or influence the spray after exiting from the container, that apparatus often has to be notably larger or significantly longer than the aerosol container or canister itself and, as a result, is usually bulky or otherwise awkward or inconvenient to carry. In the event it does not form a 'permanent part' of the aerosol product, is not convenient to carry and/or is not inherently simple to fit or operate then its use is either avoided or ignored and the spray is used too close—with unwanted results.

From one aspect, the present invention provides apparatus comprising a canister or other container that dispenses particulate (usually) under pressure and which is provided not only with a valve but also a spacer member, wherein the spacer member is moveable between a first position which is convenient for carrying and storage and a second position that dictates the minimum distance at which the product is applied from an area, object or surface.

The first position may also serve to protect that valve and/or nozzle and to prevent discharge of material from the container either occurring at all or at least inhibit it from reaching the area, object or surface. The second position dictates the minimum distance between the release point of the aerosol spray or particulate and the point where it can directly impact the target surface, area or object. If the first position prevents operation of the valve then the second position not only enables it but also dictates the minimum distance. Through the use of telescopic or extending parts or by doubling as a carrying and storage container for the aerosol container the spacing member may also, in its first position, take up less space than the minimum distance it dictates for the aerosol spray or particulate in its second position. Designed in this way it can be much more convenient to retain with the core product that is the aerosol container itself and therefore be easier and more likely to be employed.

From another aspect the present invention provides an assembly for fitting to a canister or other container that dispenses particulate, the assembly comprising a first part being adapted to be attached to the canister or other container, and a second part being attached to the first part such that in use the second part is moveable with respect to the first part between a first position which is convenient for carrying and storage and a second position that dictates the minimum distance at which the product is applied from an area, object or surface.

In order that the present invention be more readily understood, embodiments thereof will now be described by way of example with reference to the accompanying drawings, in which.

Figure 11:
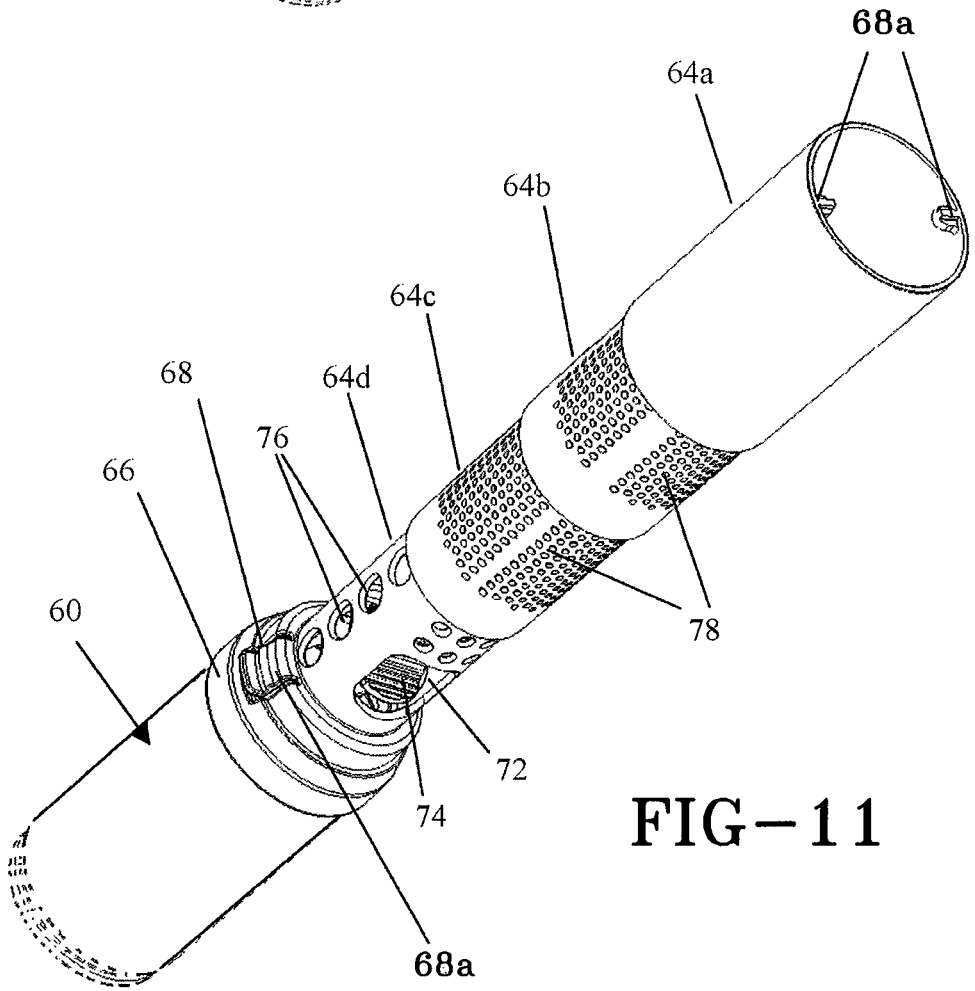
FIG. 11 shows the fifth embodiment in the second position.
Figure 11A:
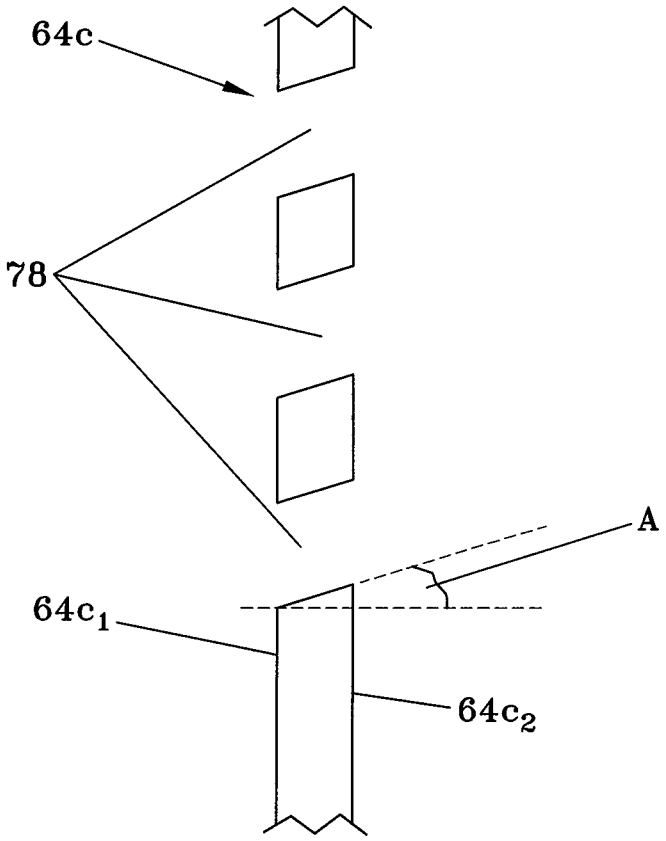
Figure 12:
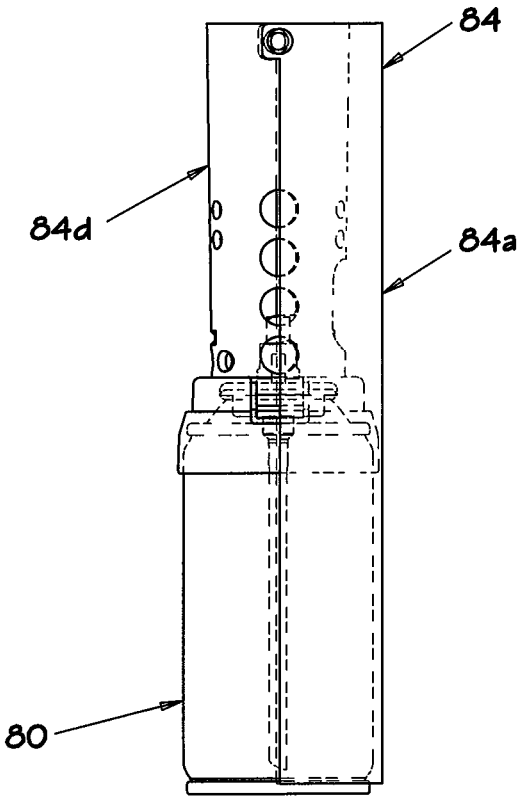
Figure 13:
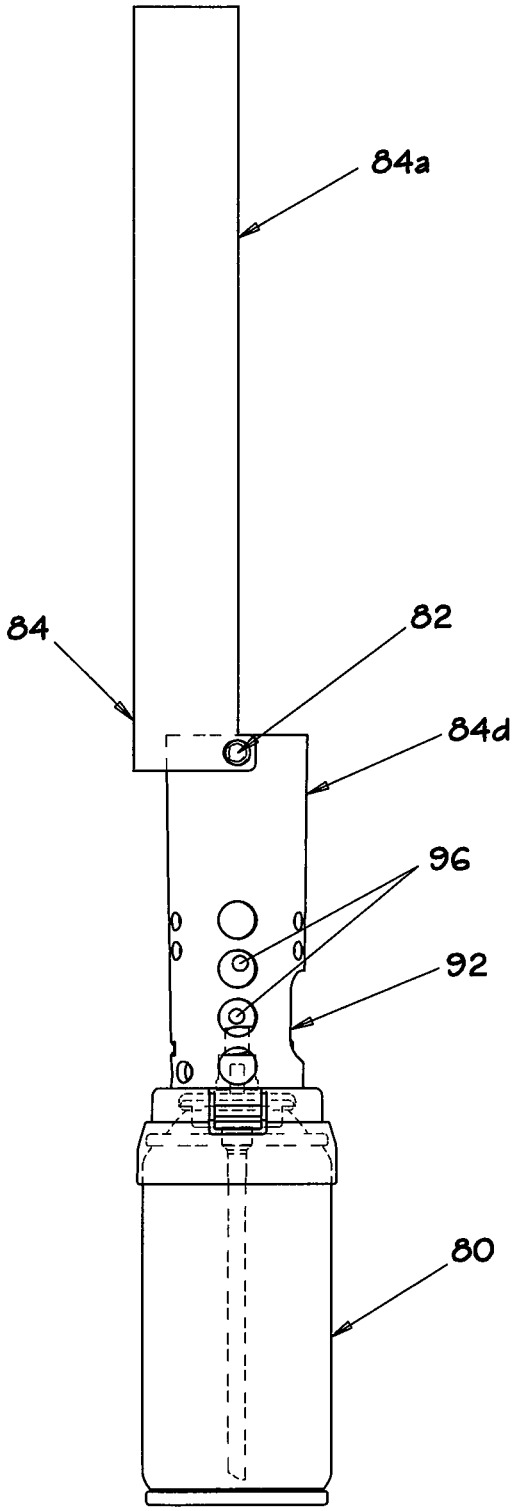

FIG. 11*a* shows a detailed view of apertures in one of the intermediate sections of FIG. 11;

FIG. 12 shows a sixth embodiment of the present invention in a first position; and FIG. 13 shows the sixth embodiment in the second position;

Aerosol containers usually have manually operable valves which have an outlet aperture pointing either axially along the length of the container or radially, transversely to the axis of the container, although some may be at angles in between the two or adjustable angles. We have designed and explain below specific arrangements to deal with these two most common different orientations of valve aperture although variations of the theme will suit different orientations.

Figure 1:
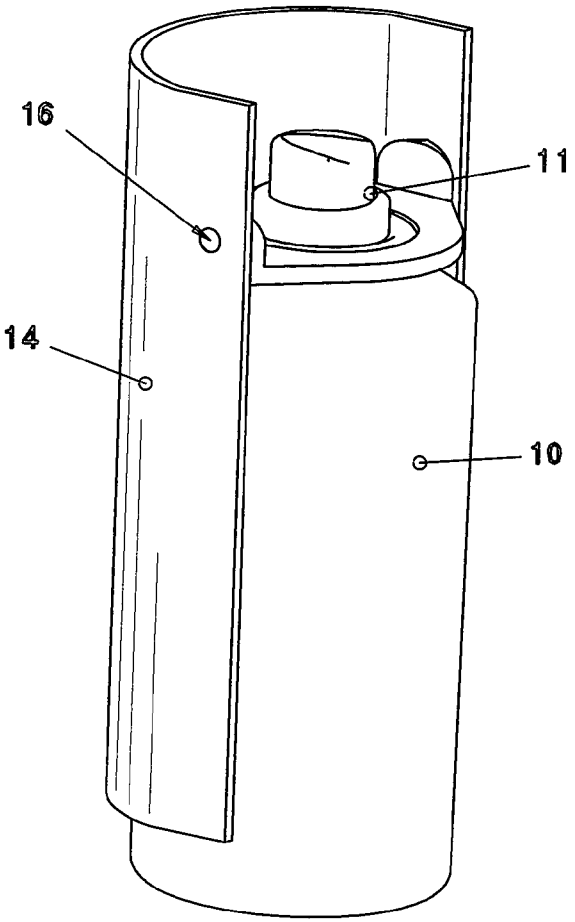
FIG. 1 shows a first embodiment of the present invention in a first position.

The first embodiment is designed to be a unitary assembly of container and spacer member for use with an aerosol container whose nozzle or actuator aperture is directed radially to the axis of the container and a detailed description of this first embodiment will now be given with reference to FIGS. 1 and 2. The container 10 is shown as being a conventional cylindrical container one end of which is provided with a manually operable valve which has a radially directed nozzle or actuator outlet aperture 11. Attached to the exterior of the container 10 is a spacer member 14 which has an arcuate cross section and which is pivotally connected to the container 10 at points 16, only one of which is shown in FIG. 1, at a position spaced from the ends of the member 14 so that a part of the member 14 projects above the top of the container 10 by a distance sufficient to result in any aerosol, spray or particulate discharged from the outlet aperture of the valve of the container striking the arcuate surface of the member 14. In this position, termed the first position, the member 14 forms a shield to prevent any aerosol, spray or particulate discharged from the container reaching or directly impacting a given surface, area or object. It may also be left attached to the container without significantly changing the size or shape of the container or otherwise adversely affecting the carrying or storage of the product. In this way it is always available for use.

The arcuate extent of the member 14 is shown as being substantially around half the circumference of the container 10 but this can be altered as desired. Equally it is shown as being attached to the container when in both the first and subsequent operative or second positions but an alternate embodiment may be one in which the container is wholly or partially housed by the member 14—for example where the container is contained within a cylinder that may be cut and hinged longitudinally.

Figure 2:
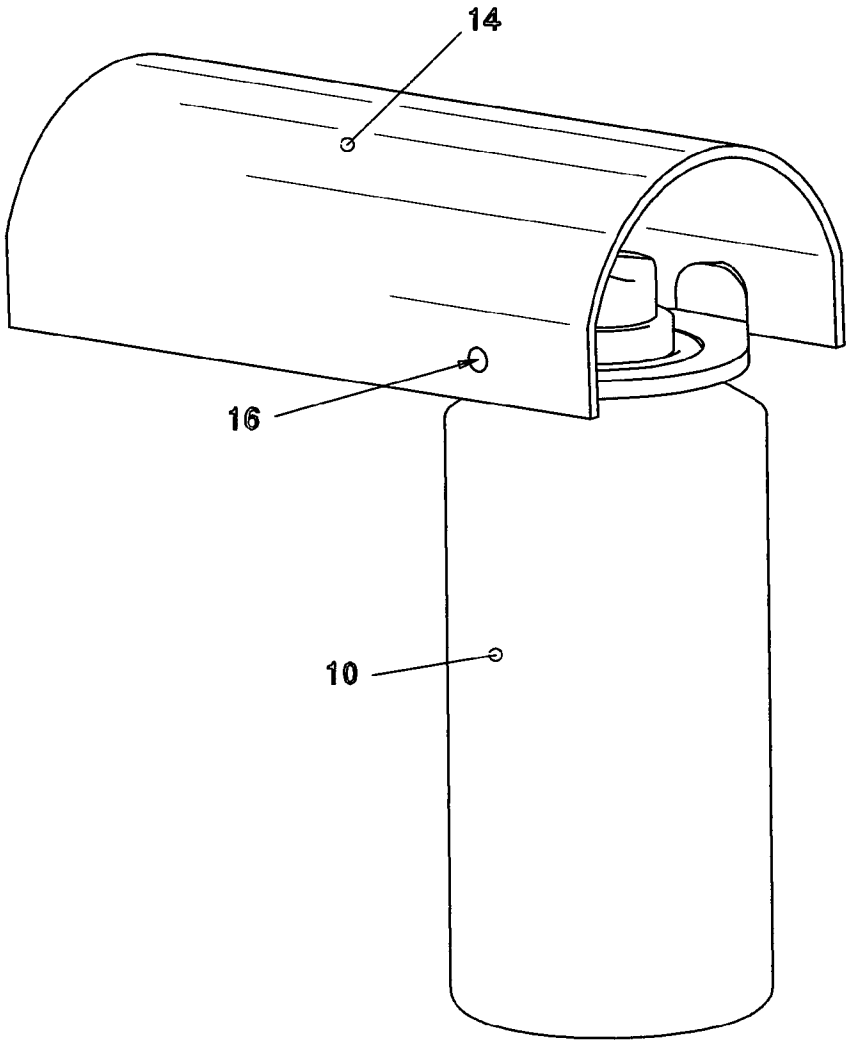
FIG. 2 shows the first embodiment in a second position.

As shown in FIG. 2, the member 14 is pivotal about the points 16 so that it can adopt an operative or second position such that the member 14 is radial to the container 10. In this position it is possible to operate the actuator 11 of the container and the resultant aerosol, spray or particulate discharge will travel down the length of the member 14 towards a surface, object or area. It will be appreciated that the length of the member 14 will thus dictate the minimum distance at which the aerosol, spray or particulate from container 10 can be positioned with respect to a surface, object or area. It may be that the member 14 can be a single member as shown in the drawings but it is equally possible for the member 14 to be made of two or more telescopically extending or folding portions. If desired, the container and/or the member 14 can be suitably formed so as to provide a retention means for holding the member 14 in the position shown in FIG. 2. Other modifications are possible both to the exact shape of the member 14 and its construction. For example it may be provided with apertures along its length or it may be lengthened simply by the use of rods that extend to a given distance.

Figure 4:
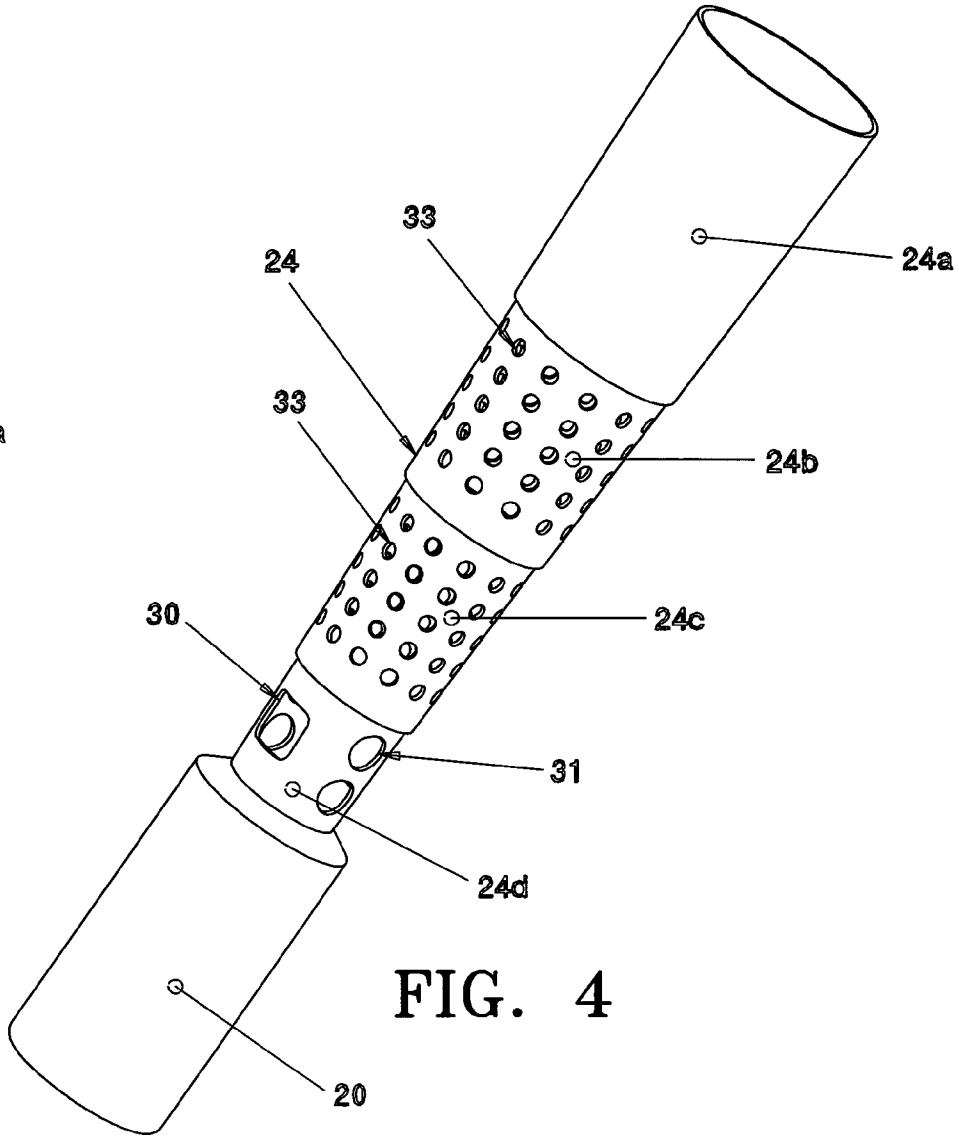
FIG. 4 shows the second embodiment in a second position.
Figure 3:
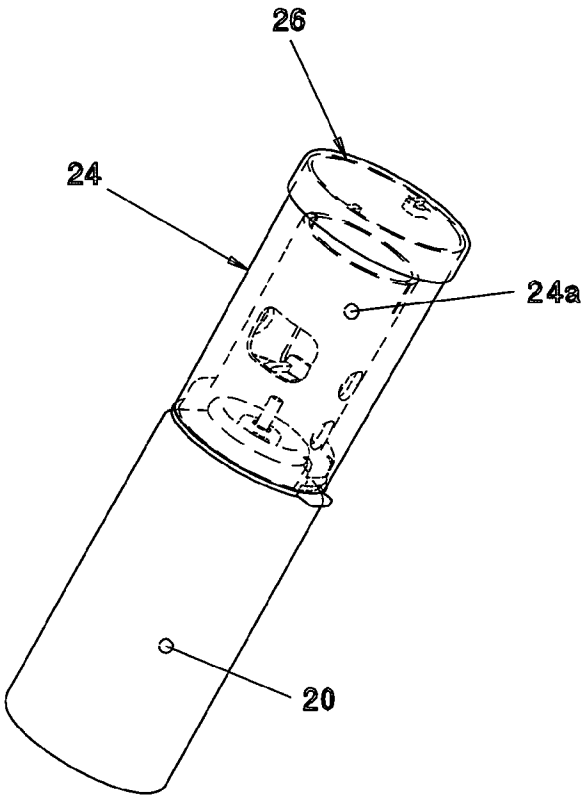
FIG. 3 shows a second embodiment of the present invention in a first position.

Turning now to FIGS. 3 and 4, this is an embodiment which is designed to be utilised with an aerosol container whose valve has an outlet aperture directed axially or broadly axially of the container. In this embodiment, the container has a reference numeral 20 and the spacer member has a reference numeral 24. It will be seen from FIGS. 3 and 4 that the spacer member 24 is in fact made up of a plurality of telescopically extendable sections 24*a*, 24*b*, 24*c* and 24*d*. The elements 24*b*, *c* and *d* are arranged and dimensioned so that they fit within the element 24*a* which thus constitutes the outer-most element when in a closed condition as shown in FIG. 3. If desired, a cap 26 can be provided to be attached to the end of the element 24*a* and thus retain the member 24 in the closed condition—although the principle of containing the inner sections may also be achieved in other ways such as the addition of a lip to the top of the outermost section 24*a*.

The exact number of telescopic sections is dependent on a number of factors one of which is the desired minimum distance at which the container outlet should be spaced from a surface area or object for proper operation and the other is the overall axial length of the product in its stored, carried or closed position. In this embodiment the minimum number of sections is two namely the sections identified as section 24*a* and 24*d*. Section 24*d* is fixed to the top of the container by fitting to the valve (something that due to wide standardisations of valves will enable the device to fit a variety of sizes and shapes of container) but it could equally be fitted to the container in many instances. Section 24*d* is provided with a first aperture 30 which provides access for a user's finger to operate the valve of the container. This finger aperture is not, of course, 'vital' to the concept. A different 'lock'/mechanical push' could also be envisaged and could equally well prevent or discourage discharge in position one (the 'too close' position) and enable it in position two (the spacing position). One or more additional apertures 31 are provided in the walls of the element (shown here in 24*d*) as this has been found to improve the performance of the apparatus under certain circumstances. It is to be noted that the size, positioning and number of apertures will affect performance of the overall product. The second section which needs to be present in this embodiment is the outer-most section 24*a*. In this embodiment this section 24*a* is the one that telescopes, thereby extending the minimum distance in the second position without being disadvantageous, awkward or inconvenient in the first position. Further, in this embodiment this outer section does not have any apertures through its side wall that are large enough to enable actuation of the valve. Consequently, when in the closed position of the member 24, it is impossible for a user to operate the valve of the container as the section 24 shields the valve and protects the nozzle or actuator while preventing use in a similar way to the role performed by a traditional aerosol cap while, at the same time, being only a little larger than such a cap.

There may be one or more intermediate sections such as those shown as 24*b* and 24*c*. Preferably one or more of the intermediate sections are provided with one or more apertures 33 as again this has been shown to provide an improved performance under certain circumstances. The preferred material for the member 24 is a plastics material and the holes are shown here as circular holes though they can differ in shape, size, quantity and position. In a modified version it is possible to replace one or more of the intermediate sections or all of them with sections having mesh walls or even solid walls but it is to be noted that the size, positioning and number of apertures will affect performance of the overall product. For example, in a modification not shown in the figures, one or more of the intermediate sections and/or the outer-most section can be formed at least from rods or pillars.

The shape of the individual sections of the member 24 in this embodiment can be varied but ideally the sections can be nested one within the other in the closed condition and be maintained in an extended position irrespective of the orientation of the container and spacer. We prefer that each of the sections be slightly tapering so that when extended the spacer member 24 has a generally conical profile. Not only does this conical shape improve performance but the other advantage of this shape is that the telescopic sections can be extended simply by flicking the assembly which causes the sections to extend and then jam against each other in the extended condition due to friction between the individual sections. Collapsing the member 24 is then simply a matter of pushing the elements together. This has the advantage of neat and easy storage and means that the device can be permanently connected to or with the container such that it is always used. Correctly designed in this way the user will not find himself in a position of being tempted (or, depending on the actuator employed, even able) to deploy the aerosol without the spacer member and therefore not potentially too close.

Figure 6:
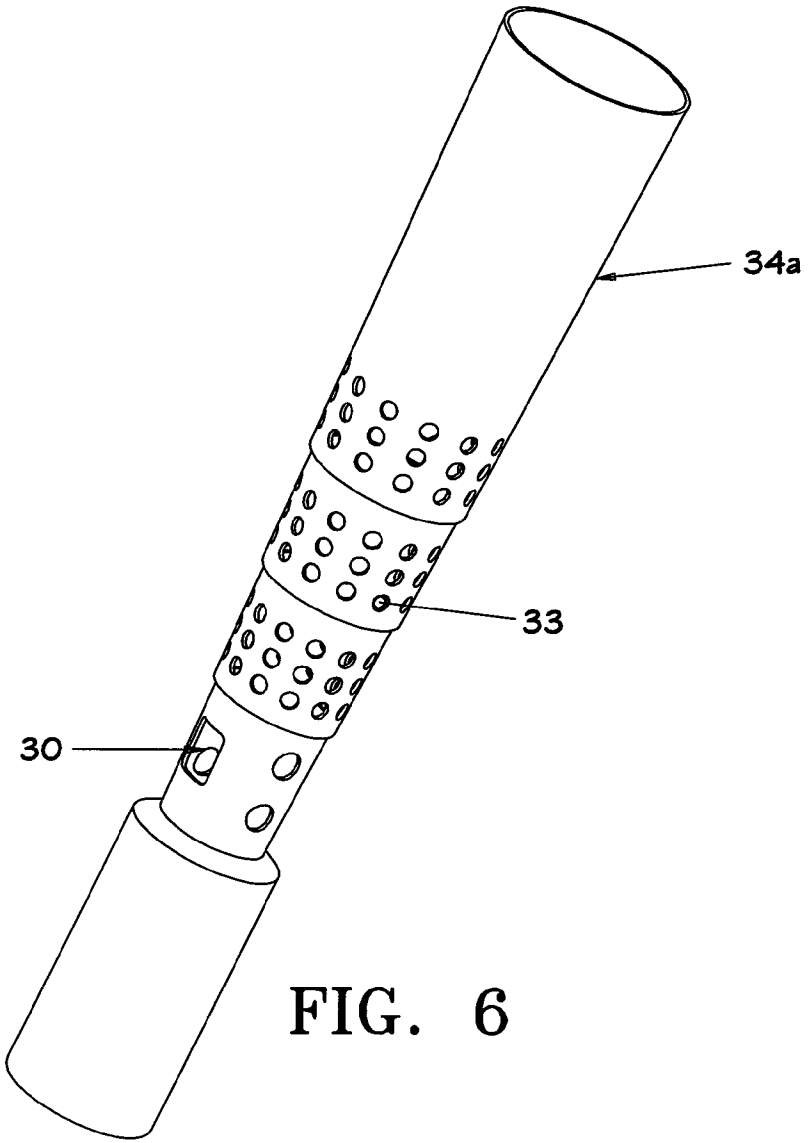
FIG. 6 shows the third embodiment in a second position.
Figure 5:
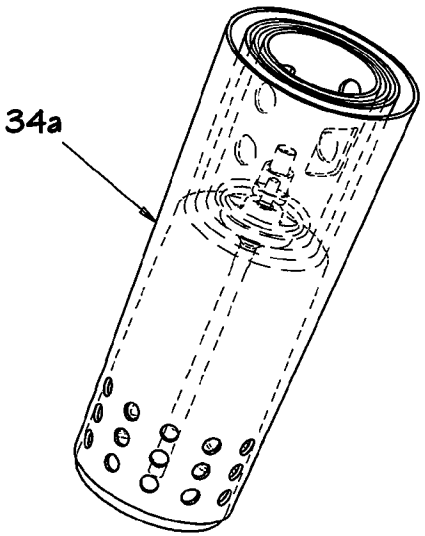
FIG. 5 shows a third embodiment of the present invention in a first position.

The third embodiment shown here in FIGS. 5 and 6 is very similar to the second but the diameter of the outermost telescopic section 34*a* is wider than the container itself and therefore encloses most or all of the container when in its closed position. This embodiment would allow for a longer distance to be introduced in position two but with less telescopic sections still without significantly increasing the size of the overall product when in its closed position. Alternatively a greater overall length of telescope could be obtained. Although apertures are shown in the lower part of the outermost telescopic section 34*a*, it should be appreciated that the outermost section could be solid without apertures (as with other embodiments described herein). As with the third embodiment the apparatus is perceived to perform better with the introduction of apertures 30 and 33.

Figure 9:
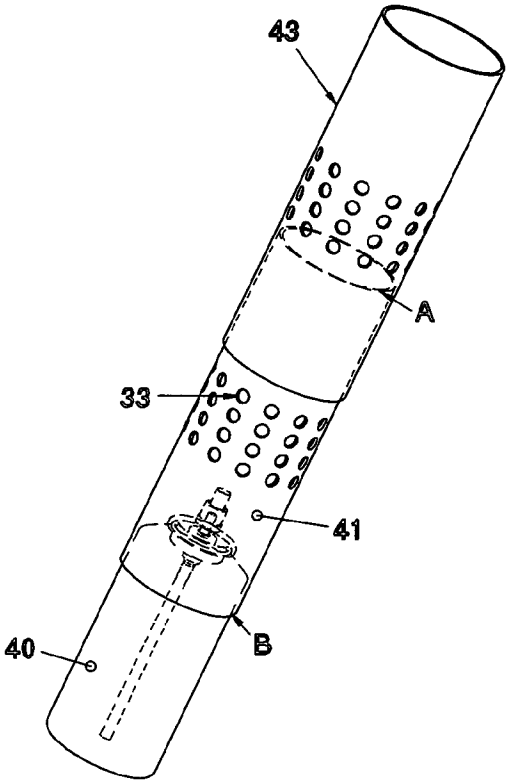
FIGS. 8 and 9 shows the fourth embodiment in a second and third position.
Figure 8:
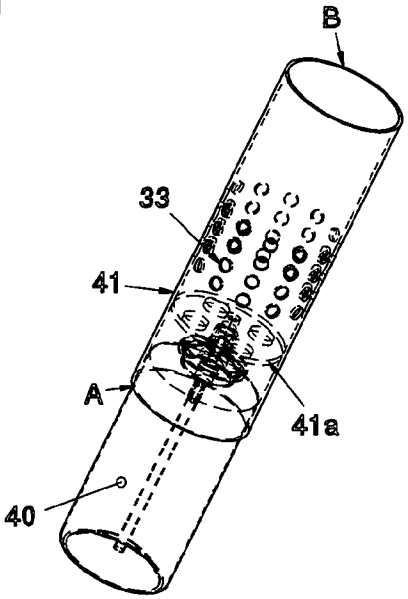
Figure 7:
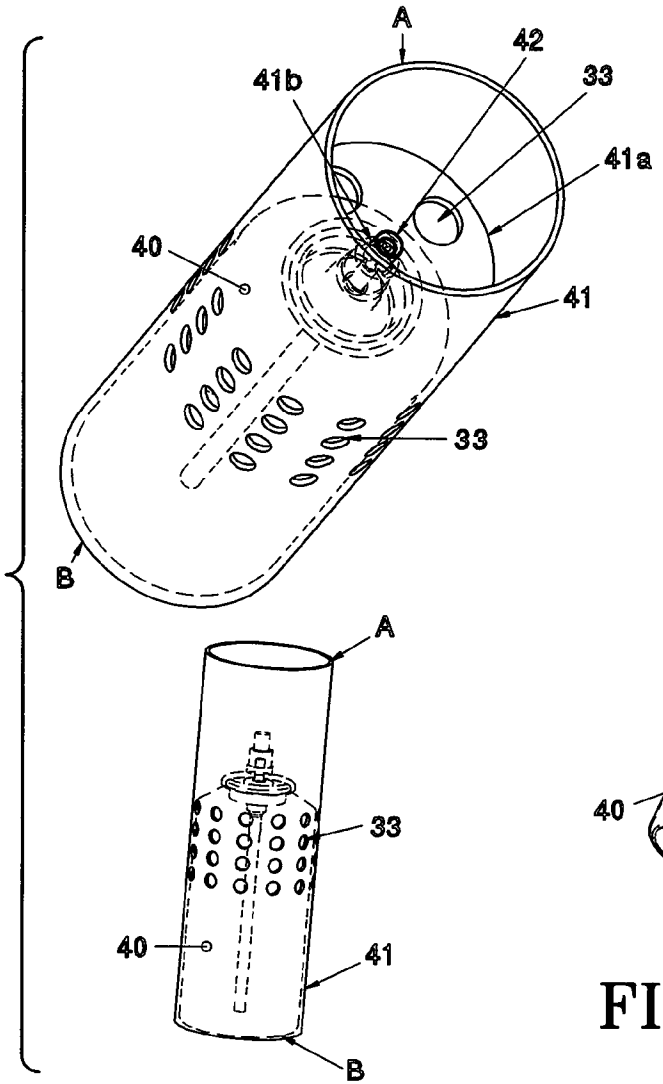
FIG. 7 shows a fourth embodiment of the present invention in a first position.

A fourth embodiment shown here in FIGS. 7, 8 and 9, is again one that contains all or most of the container in the first position (FIG. 7 its closed, storage or carrying position) but, in this embodiment the container 40 sits within a cylinder 41 that comprises the form of the spacing member and is removed from the interior of this spacing member which is itself then inverted and placed on top of the container. This can be seen in FIGS. 7 and 8 where the ends of the spacer, marked as A & B, are seen to be reversed by the act of inversion. In the embodiment shown the spacing member has an interior disc 41*a* with an aperture 41*b* at its centre through which the nozzle or actuator 4 protrudes. In this particular embodiment the nozzle or actuator cannot be depressed manually with a finger since it emits aerosol particulate or spray vertically and the finger of the operator would impede aerosol particulate or spray release. The nozzle is however, designed with a shoulder that is larger than the aperture 41*b* and pressing one against the other enables aerosol particulate or spray to be released. As with the prior embodiments the minimum distance between the exit of the aerosol particulate or spray from the container and the point at which it directly impacts the target surface, area or object can be limited by the dimensions of the spacing member and this, itself, can be adjusted by use of telescoping sections. Similarly, the spacing member can be constructed from various materials (with plastic being a preferred option) and will perform better with appropriately placed apertures (in this case in the walls of the outer section and in the disc). As with the other embodiments the design is such, however that use of the aerosol without the spacer section is either inconvenient or impossible but the spacer member is conveniently stored and carried with the aerosol product and so is more likely always to be deployed and so enhance the overall performance of the aerosol product through elimination of inappropriate residues or surface coatings.

Figure 10:
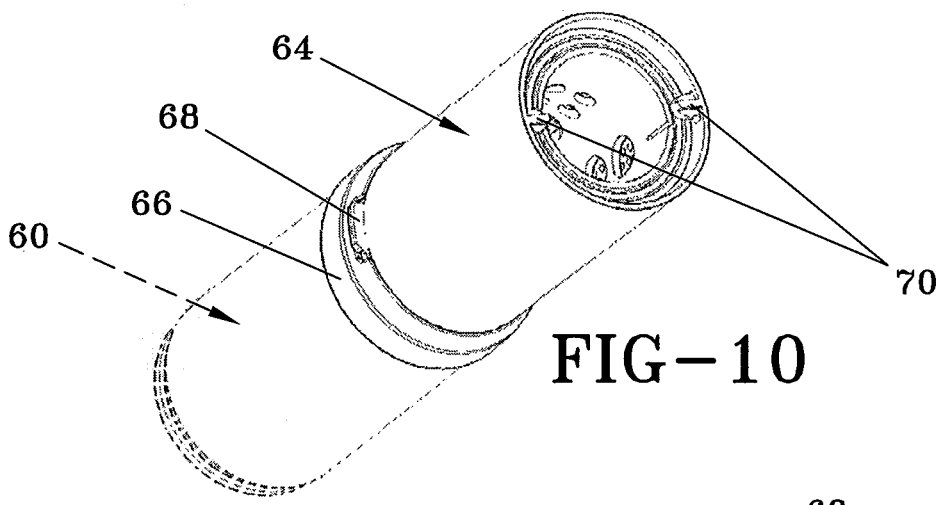
FIG. 10 shows a fifth embodiment of the present invention in the first position.

A fifth embodiment is shown in FIGS. 10 and 11 and is similar to the embodiments in FIGS. 3 and 4 in that it is designed to be utilised with an aerosol container whose valve has an outlet aperture directed axially or broadly axially of the container. In this embodiment, the container has a reference numeral 60 and the spacer member has a reference numeral 64. It will be seen from FIGS. 10 and 11 that similar to FIGS. 3 and 4, the spacer member 64 is made up of a plurality of telescopically extendable sections 64*a*, 64*b*, 64*c* and 64*d*. The elements 64*b*, *c* and *d* are arranged and dimensioned so that they fit within the element 64*a* which thus constitutes the outer-most element when in a closed condition as shown in FIG. 10. The spacer member 64 is fixed to the valve (not shown) of the container 60. A ring 66 which is formed integrally with the lower element 64*a* fits around the upper edge of the container 60.

In this particular embodiment, the retention of the member 64 in the closed condition is achieved by means of a movable element 68 which is operable by a user of the apparatus and one or more lips 70 that are formed in the top of the outermost section 64*a*. The movable element 68 is formed as part of the ring 66 and has elastic properties enabling movement with respect to ring. The movable element 68 includes an abutment portion 68*a* to abut the inner surface of the outer-most element 64*a*. This arrangement provides a friction lock on the outer-most element 64*a* preventing release of the outer-most element 64*a* when the member is in the first position. When the movable element 68 is pressed down, the friction lock be released and the outer-most element 64*a* is capable of extending. Accordingly, the element 68 is capable of serving as an operation button to enable extension of the member 64. The lips 70 are formed at the end of the outer-most element 64*a* and can abut the edges of at least the elements 64*b* and 64*c* thereby preventing release of elements 64*b* and 64*c*. The length of each lip 70 is such that the members 64*b* and 64*c* are prevented from extending past element 64*a* and also causing 64*b* and 64*c* to concertina when 64*a* is concertinaed.

As with the embodiments in FIGS. 3 to 9, the exact number of telescopic sections in this embodiment is dependent on a number of factors one of which is the desired minimum distance at which the container outlet should be spaced from a surface area or object for proper operation and the other is the overall axial length of the product in its stored, carried or closed position. In this embodiment the minimum number of sections is two namely the sections identified as section 64*a* and 64*d*. Section 64*d* is formed integrally with the ring 66 which is located at the top of the container and a valve receiving portion (not shown in FIG. 11) of section 64*d* is fitted to the valve of the container 60. Section 64*d* is provided with a first aperture 72 which provides access for a user's finger to operate the valve of the container. This finger aperture is not, of course, 'vital' to the concept since actuation of the valve could be achieved with levers. The valve receiving portion comprises a hole that is fitted to the valve and at one end includes an actuating lever 74 that can be accessed by a user through the aperture 72. A different 'lock'/mechanical push' could also be envisaged and could equally well prevent or discourage discharge in position one (the 'too close' position) and enable it in position two (the spacing position). One or more additional apertures 76 are provided in the walls of the element (shown here in 64*d*) as this has been found to improve the performance of the apparatus under certain circumstances. Furthermore these apertures and the venturi apertures 78 (described in more detail later) have been found to eliminate inappropriate residue on the inner surface of the member 64. The second section which needs to be present in this embodiment is the outer-most section 64*a*. In this embodiment this section 64*a* is the one that telescopes, thereby extending the minimum distance in the second position without being disadvantageous, awkward or inconvenient in the first position. Further, in this embodiment this outer section does not have any apertures through its side wall that are large enough to enable actuation of the valve. Consequently, as with the previous embodiments when in the closed position of the member 64, it is impossible for a user to operate the valve of the container as the section 64*a* shields the valve and protects the nozzle or actuator while preventing use in a similar way to the role performed by a traditional aerosol cap while, at the same time, being only a little larger than such a cap.

There are one or more intermediate sections such as those shown as 64*b* and 64*c*. Preferably, one or more of the intermediate sections are provided with one or more apertures 78 as again this has been shown to provide an improved performance under certain circumstances.

In this embodiment, the orientation of the apertures is not necessarily perpendicular to the planar surface of the spacer member 64. The apertures 78 may be angled as shown in more detail in FIG. 11*a*. FIG. 11*a* shows part of the wall of section 64*c* with three apertures 78. There is an angle A between the opening of the outer surface 64*c*, of the section 64*c* and the inner surface 64$c_2$ of the section 64*c*. The same apertures can be provided in other sections. The optimum angle between the outer surface and inner surfaces of the sections will depend on the combination of formulae, nozzle, valve and desired effect. It has been found that as a result of the angled apertures, an optimised venturi effect is provided thereby improving performance by adding higher volume of air assisting particle break up in the member 64.

The preferred material for the member 64 is a plastics material although other materials including but not limited to card, glass fibre or metal could be used and the apertures are shown here as circular apertures though they can differ in shape, size, quantity and position. In a modified version it is possible to replace one or more of the intermediate sections or all of them with sections having mesh walls or even solid walls but it is to be noted that the size, positioning and number of apertures will affect performance of the overall product. For example, in a modification not shown in the figures, one or more of the intermediate sections can be formed at least from rods or pillars.

As with the embodiment in FIGS. 3 and 4, the shape of the individual sections of the member 64 in this embodiment can be varied but ideally the sections can be nested one within the other in the closed condition and be maintained in an extended position irrespective of the orientation of the container and spacer. We prefer that each of the sections be slightly tapering so that when extended the spacer member 64 has a generally conical profile. Not only does this conical shape improve performance but the other advantage of this shape is that the telescopic sections can be extended simply by flicking the assembly which causes the sections to extend and then jam against each other in the extended condition due to friction between the individual sections. Collapsing the member 64 is then simply a matter of pushing the elements together. This has the advantage of neat and easy storage and means that the device can be permanently connected to or with the container such that it is always used. In alternate embodiments (not shown) the locking mechanism may also be achieved alternately than locking, friction fit tapers. It may be advantageous to use a number of other, alternate locks, such as bayonet, twist and click, spring button or interconnecting ridge rims depending on the performance requirements of the lock. Correctly designed in this way the user will not find himself in a position of being tempted (or, depending on the actuator employed, even able) to deploy the aerosol without the spacer member and therefore not potentially too close.

FIGS. 12 and 13 show a sixth embodiment. As with previous embodiments shown in FIGS. 3 to 11, a spacer is provided that is designed to be utilised with an aerosol container whose valve has an outlet aperture directed axially or broadly axially of the container. In this embodiment, the container has a reference numeral 80 and the spacer member has a reference numeral 84. Different to the embodiments shown in FIGS. 3 to 11, the spacer member 84 includes a hinged arrangement rather than a telescopic arrangement.

As with the embodiment in FIGS. 10 and 11, a section 84*d* of the spacer member 84 is attached to the container 80 in an appropriate manner and preferably by being attached to the valve (not shown) of the container 80. The section 84*d* also has features that are similar to the inner-most section 64*d* described with respect to FIGS. 10 and 11. In particular, a number of apertures 96 are provided to allow air flow. An access hole 92 allows a user to access the valve of the container so that particulate can be released from the container 80. The top of the section 84*d* is pivotally connected to a hinging section 84*a* through a pivot 82. The hinging section 84*d* has an arcuate cross section but it will be appreciated that other cross sectional shapes could be provided if the shape allows the hinging section to be convenient for carrying and to inhibit access to the valve of the container when in the first position.

In a first position, the hinging section 84*a* extends along one side of the container 80 and section 84*d* so as to inhibit access to the valve of the container from one side of the section 84*d*. From the first position, the hinging portion is rotated about the pivot 82 to a second position in order to set a distance from the outlet aperture of the container 80 and a target area to be sprayed. The hinging section 84*a* is locked when is axially aligned with the section 84*d*.

In this particular embodiment access to the valve and actuating nozzle of the aerosol is impeded when the hinging section or spacer is in its enclosed position and enabled when it is folded out. Although not shown here the device could also telescope or otherwise extend further to ensure correct distance between nozzle and target.

With any of the embodiments disclosed above, it is possible to provide a spacer such that in the operative position, the container cannot be positioned closer than, for example, 6 to 10 inches from surface, object or area and any of these designs, when used in conjunction with a suitable formula, valve and nozzle selection will serve to minimise or eliminate the deposit of unwanted residue (such as in the case of aerosol smoke detector testers or deodorants) or deliver a smooth and even deposit of spray coating without bubbles, droplets, run off or streaming (such as in the case of furniture polish or paint spray).

In some of the above embodiments, it is noted that the transition of the spacer from the first position, which is convenient for carrying and/or storage, to the second operative position, which determines a minimum distance between the outlet aperture and the target surface area or object for the spray, aerosol or particulate, occurs whilst the spacer is fixed to the container. That is, the spacer does not have to be detached from the container to perform its function in the second position from the first position or vice versa.

The preferred embodiment thus provides a spacer arrangement that is connected to or contains a container, preferably in the form of an aerosol canister during the usual carrying of the container and which does not make the container significantly larger or more bulky to carry but, either by hinging, telescoping, inverting or otherwise extending into an operative position acts as a spacer that inhibits use of the aerosol spray or particulate too close to a surface. The required length of the spacer is a function of the formula of the product and the valve and nozzle selected as well as by the amount of air that is/can be introduced to the spray as it travels the length of the spacer. In the event that the spacer is one that encloses the aerosol, spray or particulate by being a cylinder, cone or tube then the performance of the overall device is impacted by the number, type, size, shape and positioning of holes that may be introduced into the walls of the spacer. In a further development of this concept the device is arranged such that it cannot be used when the spacer member is not in place or is closed thereby preventing use too close and its use is only enabled when the spacer member is properly positioned—thereby dictating the minimum distance. In this way inadvertent use 'too close' is inhibited or prevented.

The apparatus is particularly useful for testing gas and/or combustion product detectors (for example, smoke detectors) where it is preferable to space the container containing test medium at a certain distance from the detector. Also, such a use of the apparatus is advantageous as gas and/or combustion product detectors are normally positioned at different locations so the apparatus described herein which is convenient for carrying and easy to use would be particularly suitable for testing smoke detectors. Other uses are envisaged for this apparatus, for example, in the application of paint and/or polish where a minimum distance could be considered the optimum distance to achieve the best results when applying the paint and/or polish.

The invention claimed is:

1. Testing apparatus for testing a gas or combustion product detector comprising:

a container containing a material dispensable as a spray, aerosol or particulate through an outlet aperture, wherein the material dispensable as a spray, aerosol or particulate is representative of a gas and/or combustion product for testing a gas or combustion product detector, and wherein the container includes a valve actuator or switch arranged to be actuated by a user in order to enable release of the spray, aerosol or particulate through said outlet aperture, said outlet aperture pointing axially to the container axis; and a spacer member, wherein the spacer member is movable between a first position which is convenient for carrying or storage and a second position which determines a minimum distance between the outlet aperture and a target surface area or object of the product detector for the spray, aerosol or particulate, said spacer member having a ring attached to the container at one end, said ring having a section axially extending from said ring wherein said axially extending section is narrower in diameter than said container, said spacer member comprising one or more telescopically extending sections, wherein said one or more sections are narrower than an outer diameter of said container, and wherein said one or more sections inhibit access to actuation of the valve actuator or switch when in said first position, and wherein said one section attached to the ring is provided with a side wall having a side wall aperture to permit access of a user's finger to the valve actuator or switch of the container and operation of the valve actuator or switch when the spacer member is in said second position such that a distal end of one or more sections opposite said end attached to the container is proximal said target area, wherein there are one or more intermediate sections between a furthest section from the container and the section attached to the ring and wherein any or all of the intermediate sections each has a side wall, and at least one said side wall is provided with a plurality of apertures, and one or more intermediate sections and the furthest section of the spacer member are arranged to move solely in an axial direction to the container axis, between the first position and second position, and wherein the material dispensable as a spray, aerosol or particulate that is representative of a gas and/or combustion product is adapted to be released from the furthest section of the container to the target area which is different than the side wall aperture which permits access of a user's finger to the valve actuator or switch of the container when the spacer member is in the second position.

2. Apparatus according to claim 1, wherein the spacer member when in the first position is arranged to inhibit the aerosol spray or particulate from directly impacting the target surface, area or object.

3. Apparatus according to claim 1, wherein the spacer member and container form a unitary assembly in both the first and second positions.

4. Apparatus according to claim 1, wherein the spacer member is fixed to the container.

5. Apparatus according to claim 1, wherein the container is received in an assembly which includes the spacer member.

6. Apparatus according to claim 1 wherein in the second position of the spacer member, operation of the valve actuator or switch is enabled.

7. Apparatus according to claim 1 wherein in the first position of the spacer member, the operation of the valve actuator or switch is inhibited.

8. Apparatus according to claim 1 wherein the spacer member is arranged to extend to its operative length.

9. Apparatus according to claim 1, wherein in the first position the spacer member is retracted and in the second position the spacer member is extended.

10. Apparatus according to claim 1, wherein the telescopically extending sections form a generally conical profile.

11. Apparatus according to claim 10, wherein the generally conical profile diverges in a direction away from the container.

12. Apparatus according to claim 10, wherein the generally conical profile converges in a direction away from the container.

13. Apparatus according to claim 1, wherein the side wall of the spacer member is provided with a plurality of venturi apertures.

14. Apparatus according to claim 1, wherein at least some of the plurality of apertures are angled.

15. Apparatus according to claim 1, wherein any or all of the sections are formed at least in part of a mesh.

16. Apparatus according to claim 1 wherein the spacer member and/or the container is formed to provide means for maintaining the spacer member in the second position.

17. Apparatus according to claim 1 wherein the valve actuator or switch provided with the outlet aperture and the spacer member when in the first position protects the valve actuator or switch.

18. Apparatus according to claim 1, wherein one of said sections constitutes an outer-most element when said spacer member is in said first position, said outer-most element not having any side wall apertures to enable actuation of the valve actuator or switch.

19. Apparatus according to claim 1 further comprising a movable element formed as part of said ring, said movable element engageable with at least one of said one or more sections to hold said one or more sections in said first position and wherein deflection of said movable element releases said one or more sections to move to said second position.

20. Apparatus according to claim 1, further comprising an actuating lever extending within said section axially extending from said ring and accessible through said side wall aperture, wherein said actuating lever is coupled to said valve actuator or switch and movable by the user's finger.

21. Apparatus according to claim 1, wherein said ring is fixed to the container.

* * * * *